US011318587B2

(12) United States Patent
Hsieh

(10) Patent No.: US 11,318,587 B2
(45) Date of Patent: May 3, 2022

(54) TELESCOPIC SOCKET

(71) Applicant: KABO Tool Company, Taichung (TW)

(72) Inventor: Chih-Ching Hsieh, Taichung (TW)

(73) Assignee: KABO Tool Company, Taichung (TW)

( * ) Notice: Subject to any disclaimer, the term of this patent is extended or adjusted under 35 U.S.C. 154(b) by 0 days.

(21) Appl. No.: 17/303,036

(22) Filed: May 19, 2021

(65) Prior Publication Data

US 2021/0402574 A1 Dec. 30, 2021

(30) Foreign Application Priority Data

Jun. 24, 2020 (TW) ..... 109121681

(51) Int. Cl.
*B25B 13/48* (2006.01)

(52) U.S. Cl.
CPC ..... *B25B 13/48* (2013.01)

(58) Field of Classification Search
CPC ..... B25B 13/48; B25B 13/06; B25B 13/12; B25B 13/102; B25B 13/08; B25B 13/105; B25B 13/107; B25B 13/481; B25B 23/0021; B25B 23/0035; B25B 15/001; B25G 1/005; B25G 1/043; B25G 3/18; B25G 3/26; B23B 23/0021; B23B 23/0035

USPC ... 81/121.1, 124.4, 124.5, 186, 125, 177.85, 81/185

See application file for complete search history.

(56) References Cited

U.S. PATENT DOCUMENTS 6,901,824 B1 * 6/2005 Chen ..... B25B 13/463 81/121.1
7,454,998 B1 * 11/2008 Hsieh ..... B25B 13/06 81/119
2016/0263730 A1 * 9/2016 Cummings ..... B25B 21/02
2017/0113331 A1 * 4/2017 Lai ..... B25B 13/06

* cited by examiner

*Primary Examiner* — Hadi Shakeri
(74) *Attorney, Agent, or Firm* — Wang Law Firm, Inc.

(57) ABSTRACT

A telescopic socket includes an outer sleeve, an inner sleeve, and a jointing ring. The outer sleeve includes at least one abutting ball, plural first concave portions, and plural first protruding portions. The inner sleeve is sleeved by and slidably connected to the outer sleeve and includes at least two engaging holes, plural second concave portions, and plural second protruding portions. The second protruding portions are slidably connected to the first concave portions respectively, and the first protruding portions are slidably connected to the second concave portions respectively. The jointing ring is movably connected to the outer sleeve and includes an abutting part and an accommodating part, and the abutting part optionally abuts against the abutting ball. By controlling the jointing ring, the inner sleeve can be slid or positioned relative to the outer sleeve, and the length of the telescopic socket can be changed.

9 Claims, 7 Drawing Sheets

TELESCOPIC SOCKET

BACKGROUND OF THE INVENTION

1. Technical Field

The present invention relates to a socket and more particularly to a telescopic socket that can be extended and retracted and whose length can be changed.

2. Description of Related Art

Sockets are one of the most commonly used hand tools in assembly and disassembly operations. As the conventional sockets are available in various sizes and lengths to cope with different scenarios of use, it is generally required for an operator to prepare a plurality of different sockets, which not only are heavy but also take up a lot of storage space. Besides, sockets of different sizes and lengths are difficult to put in order and store, which causes great inconvenience to socket users.

In light of the above, improvement efforts are called for to solve the foregoing problems.

BRIEF SUMMARY OF THE INVENTION

One embodiment of the present invention provides a telescopic socket that includes an outer sleeve, an inner sleeve, and a jointing ring. The inner sleeve is sleeved by the outer sleeve and is slidably connected to the outer sleeve, and the jointing ring is movably connected to the outer sleeve. The outer sleeve includes at least one abutting ball, a plurality of first concave portions, and a plurality of first protruding portions. The at least one abutting ball penetrates the outer sleeve. The first concave portions and the first protruding portions are alternately provided on the inner surface of the outer sleeve. The inner sleeve includes at least two engaging holes, a plurality of second concave portions, and a plurality of second protruding portions. The at least two engaging holes are provided in the outer surface of the inner sleeve. The second concave portions and the second protruding portions are alternately provided on the outer surface of the inner sleeve. The second protruding portions of the inner sleeve are slidably connected to the first concave portions of the outer sleeve respectively, and the first protruding portions of the outer sleeve are slidably connected to the second concave portions of the inner sleeve respectively. The jointing ring includes an abutting part and an accommodating part. The abutting part is provided on the inner wall of the jointing ring and abuts against the abutting ball optionally. The accommodating part is provided on the inner wall of the jointing ring and is adjacent to one end (hereinafter referred to as the first end) of the abutting part.

The telescopic socket according to the foregoing embodiment can be so designed that the jointing ring further includes an elastic member provided on the inner wall of the jointing ring, and that one end of the elastic member abuts against the other end of the abutting part.

The telescopic socket according to the foregoing embodiment can be so designed that the outer sleeve further includes a projecting portion provided on the outer surface of the outer sleeve, and that the other end of the elastic member abuts against one end of the projecting portion.

The telescopic socket according to the foregoing embodiment can be so designed that the number of the at least one abutting ball is two, and that the two abutting balls penetrate the outer sleeve in a symmetric manner.

The telescopic socket according to the foregoing embodiment can be so designed that the number of the at least one abutting ball is three, and that each two adjacent ones of the three abutting balls form a central angle of 120° with respect to the center of circle of the telescopic socket.

The telescopic socket according to the foregoing embodiment can be so designed that the at least two engaging holes are provided along the same axis.

The telescopic socket according to the foregoing embodiment can be so designed that the inner sleeve further includes a slide groove provided in the outer surface of the inner sleeve, and that the outer sleeve further includes a limiting member protruding from the inner surface of the outer sleeve and slidably connected to the slide groove.

The telescopic socket according to the foregoing embodiment can be so designed that the limiting member and the at least one abutting ball are provided at the same level.

The telescopic socket according to the foregoing embodiment can be so designed that the outer sleeve further includes a C-shaped ring embedded in the outer surface of the outer sleeve and configured to connect the outer sleeve and the jointing ring.

The telescopic socket according to the foregoing embodiment can be so designed that the abutting part has an inclined surface, and that the inclined surface is provided at the first end of the abutting part.

The structural configuration described above makes it possible to change the length of the entire telescopic socket through a simple operation so that the telescopic socket can adapt to various operation environments to facilitate the locking and removal of locking devices and can also be stored with ease.

BRIEF DESCRIPTION OF THE SEVERAL VIEWS OF THE DRAWINGS

The above and other objectives, as well as the features, advantages, and following embodiments, of the present invention can be better understood by referring to the accompanying drawings, in which.

DETAILED DESCRIPTION OF THE INVENTION

Figure 1:
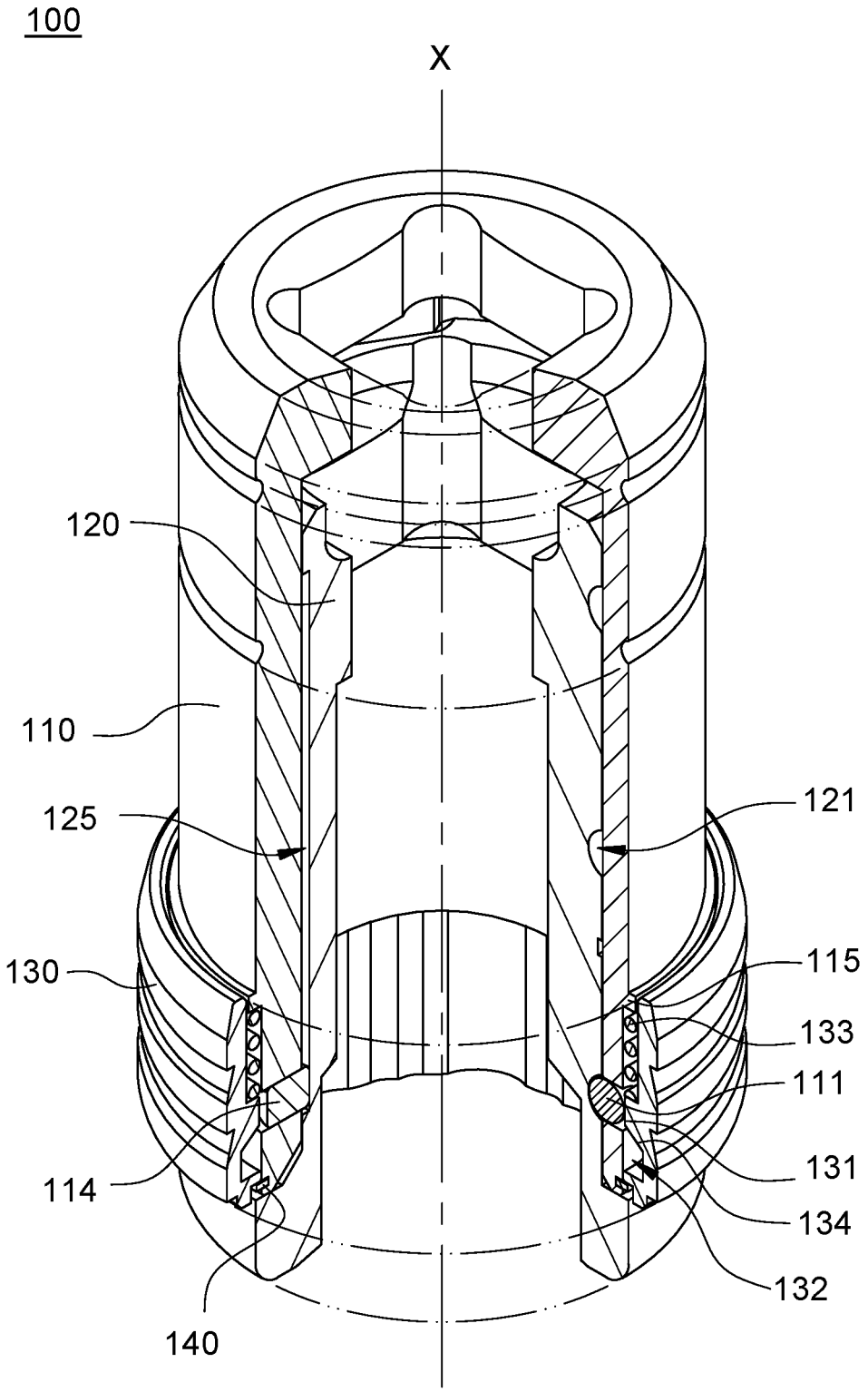
FIG. 1 is a cutaway perspective view of the telescopic socket according to one embodiment of the invention.

A number of embodiments of the present invention are described below with reference to the drawings. In order for the following description to be clear and definite, many practical details are included in the description. It should be understood, however, that those practical details are not intended to limit the invention. That is to say, the practical details are not essential to some embodiments of the invention. In addition, some conventional structures and elements are shown only schematically in the drawings for the sake of simplicity, and repeated elements may be indicated by the same reference numeral.

Figure 2:
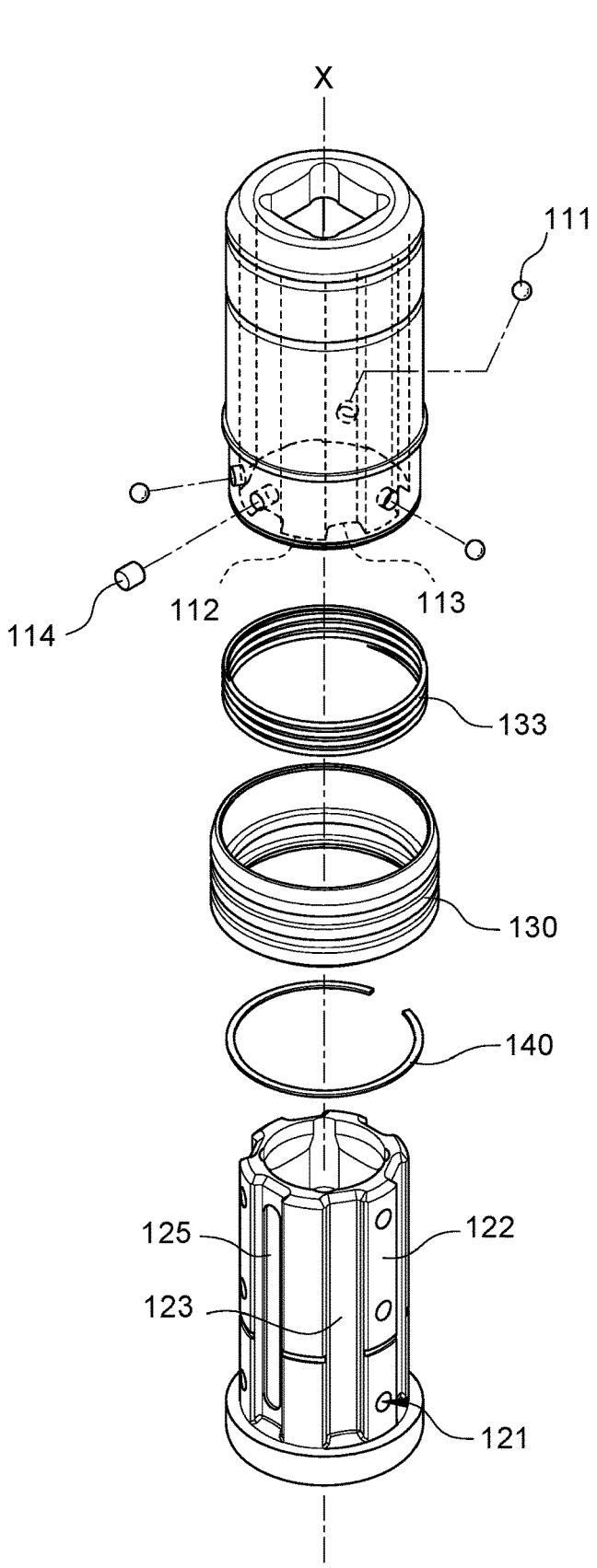
FIG. 2 is an exploded perspective view of the telescopic socket in FIG. 1.

Please refer to FIG. 1 and FIG. 2 respectively for a cutaway perspective view of the telescopic socket 100 according to one embodiment of the present invention and an exploded perspective view of the telescopic socket 100 in FIG. 1. The telescopic socket 100 includes an outer sleeve 110, an inner sleeve 120, and a jointing ring 130. The inner sleeve 120 is sleeved by the outer sleeve 110 and is slidably connected to the outer sleeve 110, and the jointing ring 130 is movably connected to the outer sleeve 110. More specifically, the outer sleeve 110 includes at least one abutting ball 111 that penetrates the outer sleeve 110. The inner sleeve 120 includes at least two engaging holes 121 that are provided in the outer surface of the inner sleeve 120. The jointing ring 130 includes an abutting part 131 and an accommodating part 132. The abutting part 131 is provided on the inner wall of the jointing ring 130 and abuts against the abutting ball 111 optionally. The accommodating part 132 is provided on the inner wall of the jointing ring 130 and is adjacent to one end of the abutting part 131.

Figure 3:
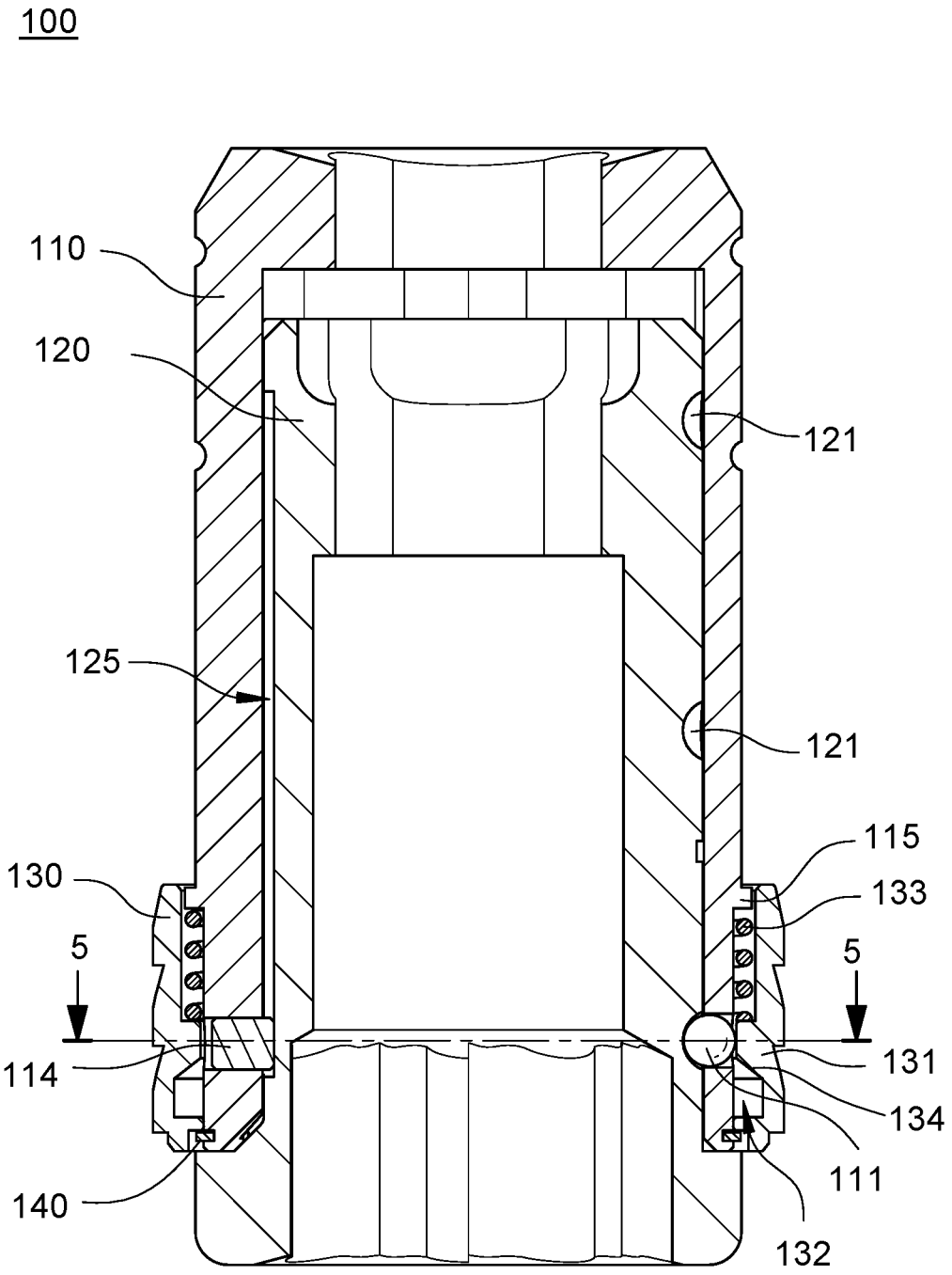
FIG. 3 is a sectional view of the telescopic socket in FIG. 1.
Figure 4:
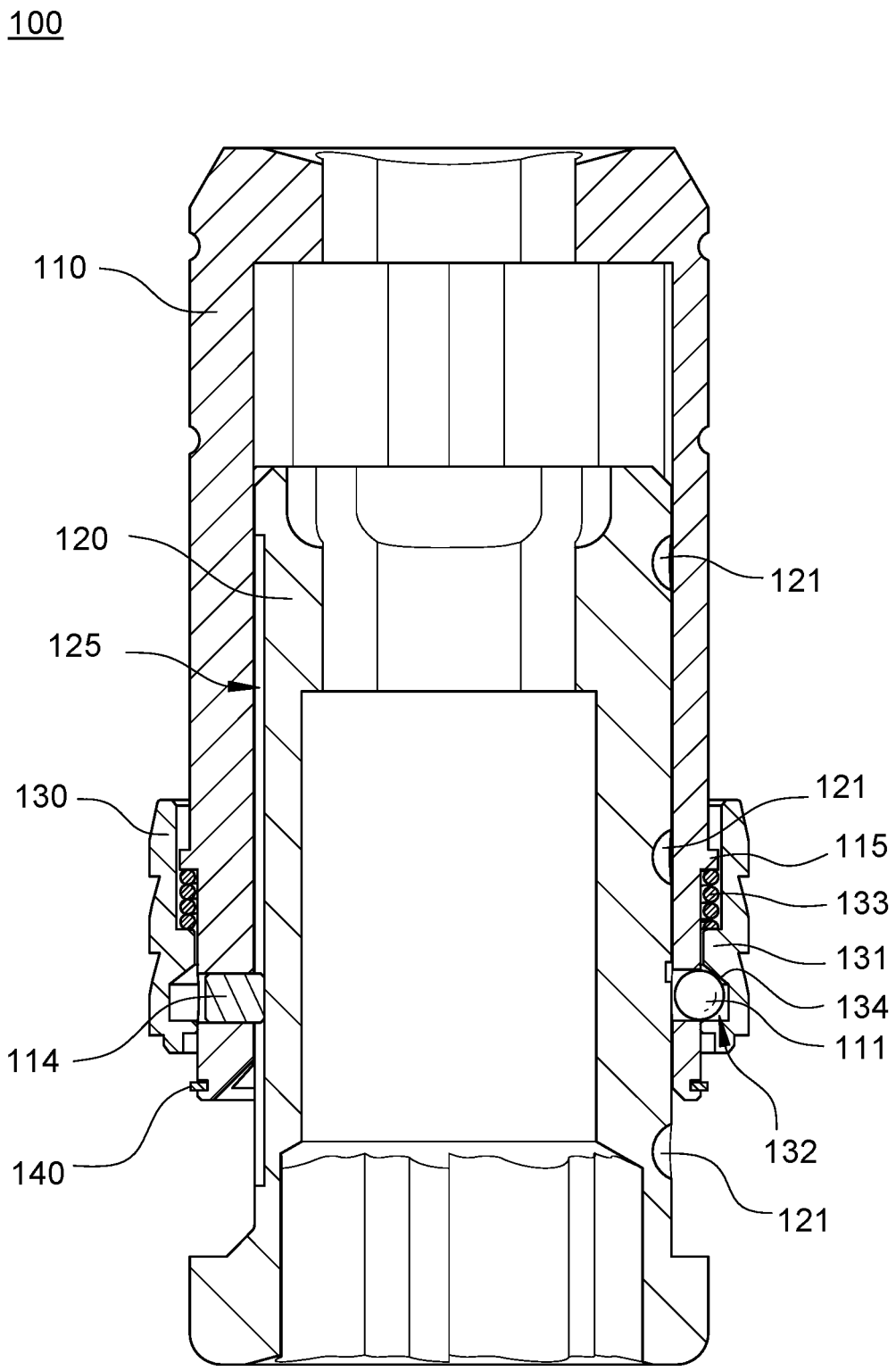
FIG. 4 is another sectional view of the telescopic socket in FIG. 1.

By controlling the position of the jointing ring 130, the abutting part 131 can be made to abut against the abutting ball 111, or the abutting ball 111 can be received in the accommodating part 132, in order to bring the telescopic socket 100 into a fixed state (as shown in FIG. 3) or a slidable state (as shown in FIG. 4).

The structural configuration described above allows the inner sleeve 120 to be slid or positioned relative to the outer sleeve 110, and the length of the entire telescopic socket 100 to be changed. Thus, the telescopic socket 100 can be adapted to various operation environments and used more flexibly than its prior art counterparts, making it easier to lock and remove locking devices. The telescopic socket 100 can be stored with greater ease as well.

Please refer to FIG. 3 for a sectional view of the telescopic socket 100 in FIG. 1. The telescopic socket 100 in FIG. 3 is in the fixed state. More specifically, as shown in FIG. 3, the at least one abutting ball 111 is engaged in one of the engaging holes 121, and the abutting part 131 abuts against the abutting ball 111; as a result, the inner sleeve 120 cannot be slid relative to the outer sleeve 110. With the abutting part 131 abutting against the abutting ball 111, the abutting ball 111 is securely engaged in the engaging hole 121 and thereby fixes the inner sleeve 120 to the outer sleeve 110 in a stable manner.

Please refer to FIG. 4 for another sectional view of the telescopic socket 100 in FIG. 1. The telescopic socket 100 in FIG. 4 is in the slidable state. More specifically, when the user wishes to change the length of the telescopic socket 100, the jointing ring 130 can be pushed in a direction parallel to the axial direction X of the telescopic socket 100 so that the abutting part 131 of the jointing ring 130 no longer abuts against the abutting ball 111. The abutting ball 111 will fall into the accommodating part 132 of the jointing ring 130, allowing the inner sleeve 120 to be slid relative to the outer sleeve 110. The inner sleeve 120 can then be slid to bring the abutting ball 111 selectively into engagement in another engaging hole 121, thus completing the operation of changing the length of the telescopic socket 100.

The abutting part 131 may have an inclined surface 134 provided at the aforesaid end of the abutting part 131. When the jointing ring 130 is moved, the inclined surface 134 can guide the abutting ball 111 from inside one of the engaging holes 121 into the accommodating part 132 or vice versa. The provision of the inclined surface 134 increases the smoothness of the operation of changing the length of the telescopic socket 100 and enhances the convenience of use of the telescopic socket 100.

The jointing ring 130 may further include an elastic member 133 provided on the inner wall of the jointing ring 130, with one end of the elastic member 133 abutting against the other end of the abutting part 131. The outer sleeve 110 may further include a projecting portion 115 provided on the outer surface of the outer sleeve 110, with the other end of the elastic member 133 abutting against one end of the projecting portion 115. Now that the two ends of the elastic member 133 abut against the abutting part 131 and the projecting portion 115 respectively, the abutting part 131 of the jointing ring 130 can be stably kept in a state in which it abuts against the abutting ball 111, thereby increasing the stability of the telescopic socket 100 in the fixed state and reducing the risk that the force application effect of the telescopic socket 100 may be compromised by displacement of the inner sleeve 120 when the telescopic socket 100 is being operated.

In addition, the provision of the elastic member 133 makes it possible that when the operation of changing the length of the telescopic socket 100 is completed, the jointing ring 130 will be automatically moved back to its original position by the elastic member 133, with the abutting part 131 automatically returning to the state in which it abuts against the abutting ball 111. Thus, the convenience of use of the telescopic socket 100 is increased.

The inner sleeve 120 may further include a slide groove 125 provided in the outer surface of the inner sleeve 120, and the outer sleeve 110 may further include a limiting member 114 that protrudes from the inner surface of the outer sleeve 110 and is slidably connected to the slide groove 125. When the telescopic socket 110 is in the slidable state, the slide groove 125 limits the extent to which the limiting member 114 can be displaced and thereby limits the extent to which the inner sleeve 120 can be slid relative to the outer sleeve 110. This prevents the inner sleeve 120 from falling off during the sliding process. Besides, as shown in FIG. 2, the limiting member 114 and the at least one abutting ball 111 are provided at the same level to enable the limiting member 114 to more effectively limit the sliding of the telescopic socket 100.

The outer sleeve 110 may further include a C-shaped ring 140 embedded in the outer surface of the outer sleeve 110 and configured to connect the outer sleeve 110 and the jointing ring 130. The provision of the C-shaped ring 140 enables a more secure connection between the outer sleeve 110 and the jointing ring 130 than without the C-shaped ring 140, thereby enhancing the stability of the entire structure of the telescopic socket 100.

The at least two engaging holes 121 correspond in position to the at least one abutting ball 111. More specifically, referring to FIG. 2, the inner sleeve 120 is provided, at positions corresponding to each abutting ball 111, a plurality of engaging holes 121 that are longitudinally arranged. The number of the engaging holes 121 that correspond in position to each abutting ball 111 is at least two, and the at least two engaging holes 121 that correspond in position to each abutting ball 111 are provided along the same axis, which is parallel to the axial direction X. Thus, the inner sleeve 120 can be slid relative to the outer sleeve 110 along the axial direction X and allows the telescopic socket 100 to be secured, through a simple operation, at positions corresponding respectively to different lengths.

In the embodiment in FIG. 1, the number of the engaging holes 121 that correspond in position to each abutting ball 111 may be three, and in that case, each abutting ball 111 can be selectively engaged in any one of the three corresponding engaging holes 121, meaning the length of the telescopic socket 100 can be changed in three stages. In fact, the number of the engaging holes 121 that correspond in position to each abutting ball 111 can be determined according to user needs so that the length of the telescopic socket 100 can be changed in a different number of stages. The spacing between the engaging holes 121 on the same axis can also be adjusted to provide more options regarding the number of the extending/retracting stages of the telescopic socket 100, thereby enabling a greater diversity of applications. The present invention, however, is not limited to the configurations disclosed above.

Figure 5:
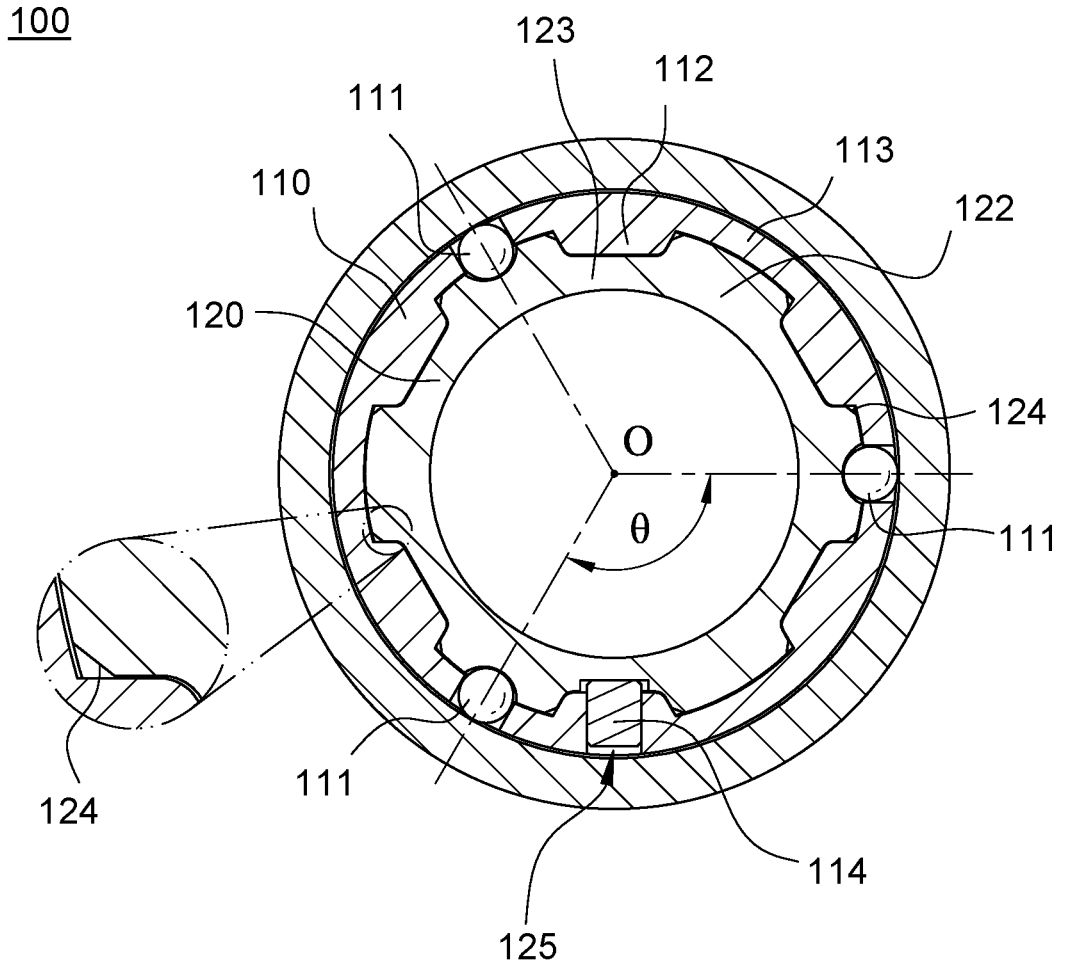
FIG. 5 is a sectional view taken along line 5-5 across the telescopic socket in FIG. 3.

Please refer to FIG. 5 in conjunction with FIG. 2, with FIG. 5 showing a sectional view taken along line 5-5 across the telescopic socket 100 in FIG. 3. In the embodiment in FIG. 1, the telescopic socket 100 has a center of circle O, and the number of the at least one abutting ball 111 may be three, with the abutting balls 111 and the center of circle O defining three equal central angles θ of 120°. More specifically, as shown in FIG. 5, each two adjacent abutting balls 111 form a central angle θ with respect to the center of circle O, and the abutting balls 111 are evenly provided in the outer sleeve 110. This allows the outer sleeve 110 and the inner sleeve 120 to be more securely connected when the telescopic socket 100 is in the fixed state, and when operated by the user, the inner sleeve 120 and the outer sleeve 110 can be slid relative to each other more stably without wobbling and therefore without compromising the force application effect of the telescopic socket 100. The number of the at least one abutting ball can be determined according to user needs and is not limited to that disclosed herein.

With continued reference to FIG. 5 and FIG. 2, the outer sleeve 110 includes a plurality of first concave portions 113 and a plurality of first protruding portions 112, wherein the first concave portions 113 and the first protruding portions 112 are alternately provided on the inner surface of the outer sleeve 110. The inner sleeve 120 includes a plurality of second concave portions 123 and a plurality of second protruding portions 122, wherein the second concave portions 123 and the second protruding portions 122 are alternately provided on the outer surface of the inner sleeve 120. As shown in FIG. 5, the second protruding portions 122 are fitted in the first concave portions 113 respectively, and the first protruding portions 112 are fitted in the second concave portions 123 respectively. Thus, the second protruding portions 122 of the inner sleeve 120 are slidably connected to the first concave portions 113 of the outer sleeve 110 respectively, and the first protruding portions 112 of the outer sleeve 110 are slidably connected to the second concave portions 123 of the inner sleeve 120 respectively. The foregoing structural arrangement allows the outer sleeve 110 and the inner sleeve 120 to connect more stably with each other, thereby enhancing the stability of the entire structure of the telescopic socket 100.

More specifically, the inner surface of the outer sleeve 110 may have the same contour as the outer surface of the inner sleeve 120, i.e., the inner surface of the outer sleeve 110 may match the outer surface of the inner sleeve 120, so that the outer sleeve 110 can be mounted stably around the inner sleeve 120. Moreover, in the embodiment in FIG. 1, the second concave portions 123 are U-shaped, with each second concave portion 123 having a plate-shaped bottom side. This configuration helps increase the area of contact between each first concave portion 113 and the corresponding second protruding portion 122 and thereby enhance the smoothness of operation of the telescopic socket 100.

Besides, as shown in FIG. 5, each second protruding portion 122 may further include at least one chamber 124, such as two chambers 124 provided respectively on two opposite lateral sides of the second protruding portion 122. The provision of the chambers 124 increases the smoothness of sliding of the inner sleeve 120 relative to the outer sleeve 110 and thereby enhances the ease of operation of the telescopic socket 100.

Figure 6:
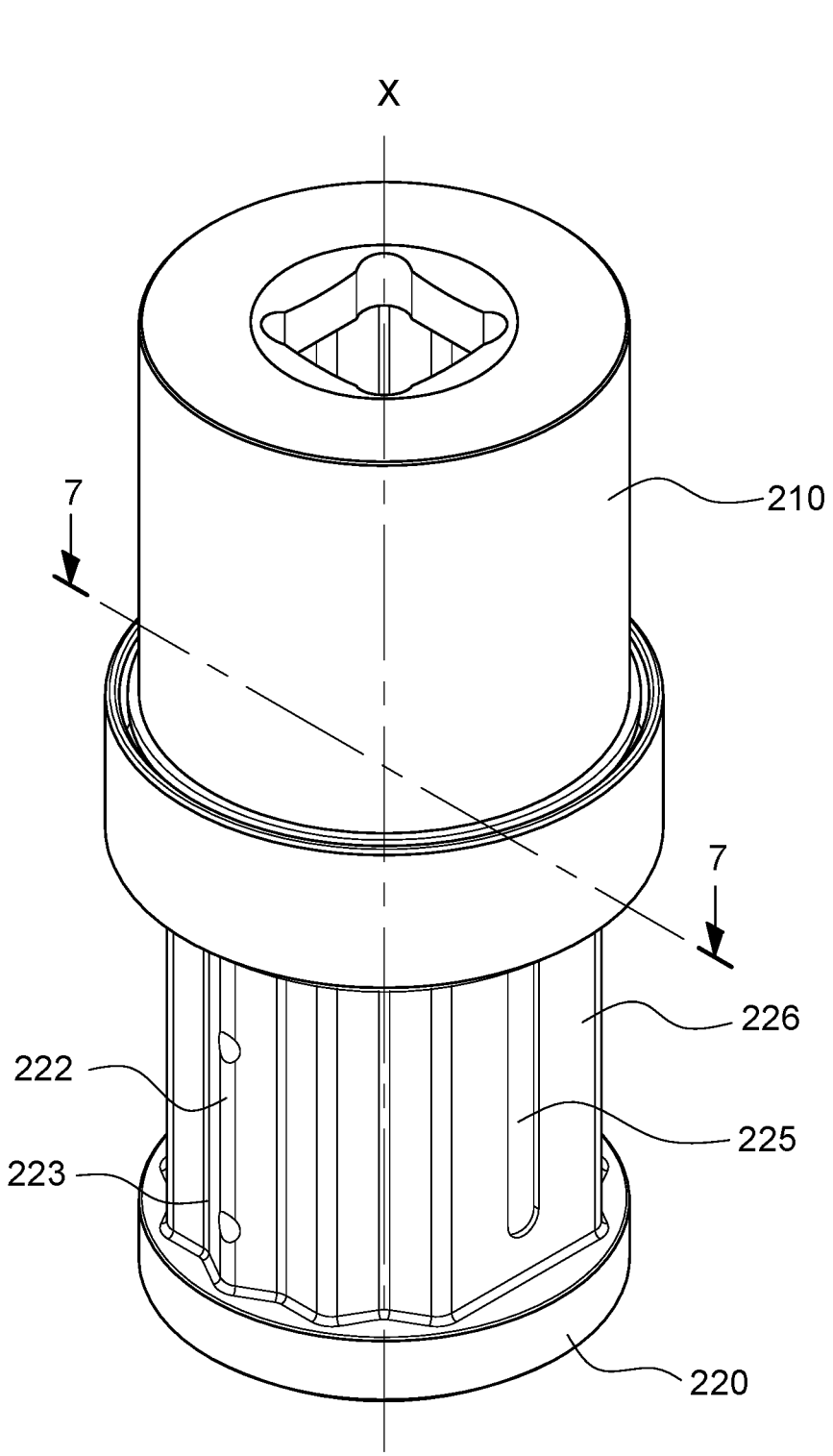
FIG. 6 is a perspective view of the telescopic socket according to another embodiment of the invention.
Figure 7:
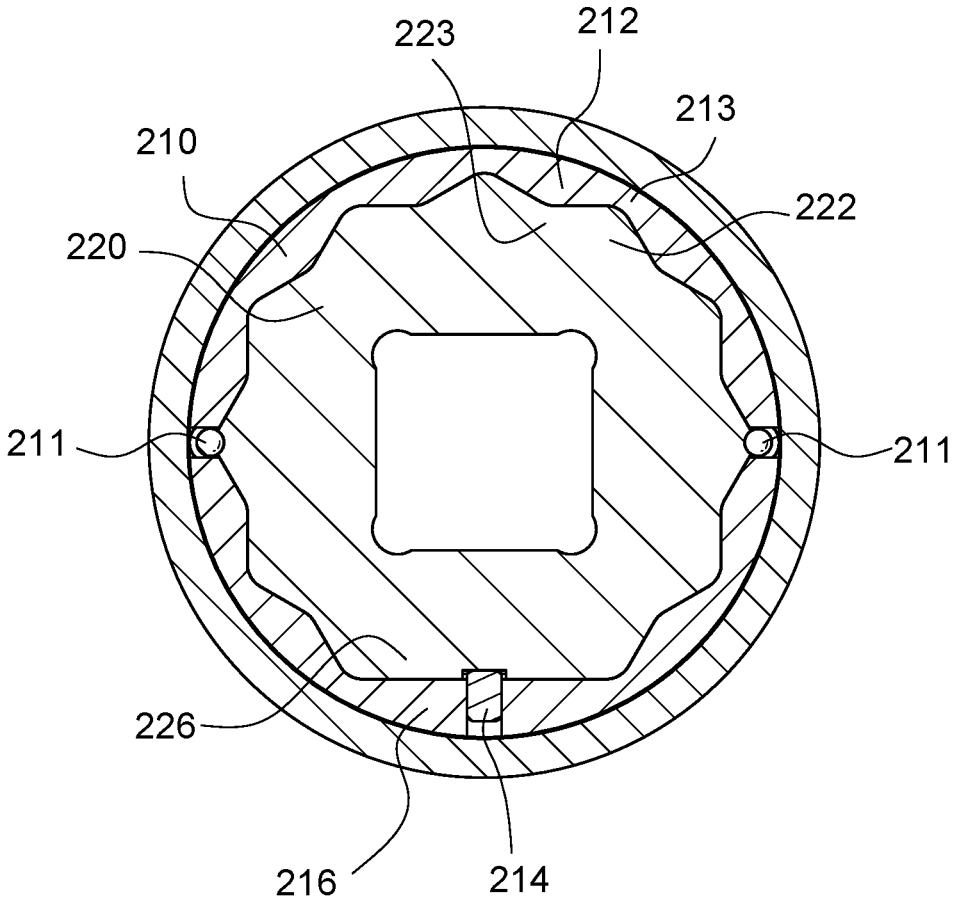
FIG. 7 is a sectional view taken along line 7-7 across the telescopic socket in FIG. 6.

Please refer to FIG. 6 for a perspective view of the telescopic socket 200 according to another embodiment of the present invention, and FIG. 7 for a sectional view taken along line 7-7 across the telescopic socket 200 in FIG. 6. The telescopic socket 200 in FIG. 6 is structurally similar to the telescopic socket 100 in FIG. 1, and the same elements and details will not be described repeatedly. The telescopic socket 200 in FIG. 6 is different in that each first protruding portion 212, each first concave portion 213, each second protruding portion 222, and each second concave portion 223 have a V-shaped side as shown in FIG. 7; that is to say, the first protruding portions 212 and the second protruding portions 222 are pointed. This configuration further enhances the stability of the connection between the outer sleeve 210 and the inner sleeve 220.

The outer sleeve 210 may include a first flat portion 216 provided on the inner surface of the outer sleeve 210, and the inner sleeve 220 may include a second flat portion 226 provided on the outer surface of the inner sleeve 220, wherein the first flat portion 216 is slidably connected to the second flat portion 226. The slide groove 225 may be provided in the second flat portion 226 in order to limit the limiting member 214 more effectively.

Furthermore, in the embodiment in FIG. 6, the number of the at least one abutting ball 211 may be two, and in that case, the two abutting balls 211 may penetrate the outer sleeve 210 in a symmetric manner, meaning the abutting balls 211 are evenly provided in the outer sleeve 210. This allows the outer sleeve 210 and the inner sleeve 220 to be more securely connected when the telescopic socket 200 is in the fixed state, and when operated by the user, the inner sleeve 220 and the outer sleeve 210 can be slid relative to each other more stably without wobbling and therefore without compromising the force application effect of the telescopic socket 200.

According to the above, the telescopic socket of the present invention allows its length to be changed by a simple operation such that the telescopic socket not only can be conveniently stored, but also is adaptable to various operation environments, making it easier to lock and remove locking devices.

While the present invention has been disclosed through the foregoing embodiments, it should be understood that the embodiments are not intended to be restrictive of the scope of the invention. A person skilled in the art may alter or modify the disclosed embodiments in many ways without departing from the spirit or scope of the invention. The scope of the patent protection sought by the applicant is defined by the appended claims.

What is claimed is:

1. A telescopic socket, comprising:

an outer sleeve comprising:

at least one abutting ball penetrating the outer sleeve;

a plurality of first concave portions; and a plurality of first protruding portions, wherein the first concave portions and the first protruding portions are alternately provided on an inner surface of the outer sleeve;

an inner sleeve sleeved by the outer sleeve and slidably connected to the outer sleeve, the inner sleeve comprising:

at least two engaging holes provided in an outer surface of the inner sleeve;

a plurality of second concave portions; and a plurality of second protruding portions, wherein the second concave portions and the second protruding portions are alternately provided on the outer surface of the inner sleeve, the second protruding portions of the inner sleeve are slidably connected to the first concave portions of the outer sleeve respectively, and the first protruding portions of the outer sleeve are slidably connected to the second concave portions of the inner sleeve respectively; and a jointing ring movably connected to the outer sleeve and comprising:

an abutting part provided on an inner wall of the jointing ring and abutting against the abutting ball optionally, the abutting part having an inclined surface provided at an end of the abutting part; and an accommodating part provided on the inner wall of the jointing ring and adjacent to the end of the abutting part.

2. The telescopic socket of claim 1, wherein the jointing ring further comprises an elastic member provided on the inner wall of the jointing ring, and the elastic member has an end abutting against an opposite end of the abutting part.

3. The telescopic socket of claim 2, wherein the outer sleeve further comprises a projecting portion provided on an outer surface of the outer sleeve, and the elastic member has an opposite end abutting against an end of the projecting portion.

4. The telescopic socket of claim 1, wherein the number of the at least one abutting ball is two, and the two abutting balls penetrate the outer sleeve symmetrically.

5. The telescopic socket of claim 1, wherein the number of the at least one abutting ball is three, and each two adjacent said abutting balls form a central angle of 120° with respect to a center of circle of the telescopic socket.

6. The telescopic socket of claim 1, wherein the at least two engaging holes are provided along a same axis.

7. The telescopic socket of claim 1, wherein the inner sleeve further comprises:

a slide groove provided in the outer surface of the inner sleeve; and the outer sleeve further comprises:

a limiting member protruding from the inner surface of the outer sleeve and slidably connected to the slide groove.

8. The telescopic socket of claim 7, wherein the limiting member and the at least one abutting ball are provided at a same level.

9. The telescopic socket of claim 1, wherein the outer sleeve further comprises a C-shaped ring embedded in an outer surface of the outer sleeve and configured to connect the outer sleeve and the jointing ring.

* * * * *